US010344482B2

(12) United States Patent
Brochu

(10) Patent No.: US 10,344,482 B2
(45) Date of Patent: Jul. 9, 2019

(54) GUTTER PROTECTION DEVICE AND GUTTER PROTECTION ASSEMBLY

(71) Applicant: Stéphane Brochu, Saint-Romuald (CA)

(72) Inventor: Stéphane Brochu, Saint-Romuald (CA)

( * ) Notice: Subject to any disclaimer, the term of this patent is extended or adjusted under 35 U.S.C. 154(b) by 0 days.

(21) Appl. No.: 15/945,592

(22) Filed: Apr. 4, 2018

(65) Prior Publication Data

US 2018/0223535 A1 Aug. 9, 2018

Related U.S. Application Data

(62) Division of application No. 15/410,458, filed on Jan. 19, 2017, now abandoned.

(60) Provisional application No. 62/280,310, filed on Jan. 19, 2016.

(51) Int. Cl.
*E04D 13/064* (2006.01)
*E04D 13/076* (2006.01)

(52) U.S. Cl.
CPC ..... *E04D 13/076* (2013.01); *E04D 13/064* (2013.01)

(58) Field of Classification Search
CPC ..... E04D 13/064; E04D 13/076
USPC ..... 52/12
See application file for complete search history.

(56) References Cited

U.S. PATENT DOCUMENTS 3,436,878 A * 4/1969 Singer ..... E04D 13/076 248/48.2
5,619,825 A 4/1997 Leroney et al.
6,134,843 A * 10/2000 Tregear ..... E04D 13/076 210/474
6,427,388 B1 8/2002 Brochu
6,786,008 B2 9/2004 Brochu
D523,538 S 6/2006 Brochu
D558,309 S 12/2007 Gregg
D569,011 S 5/2008 Brochu
7,624,541 B2 12/2009 Gentry
7,658,036 B2 2/2010 Banks et al.
7,765,743 B2 8/2010 Guilford
8,037,641 B2 10/2011 Gerig
8,191,315 B1 6/2012 Brochu
8,322,082 B2 12/2012 Neumann
(Continued)

FOREIGN PATENT DOCUMENTS

CA 2 305 159 A1 10/2001
CA 2 405 756 A1 3/2004
(Continued)

*Primary Examiner* — Brian D Mattei
(74) *Attorney, Agent, or Firm* — Merchant & Gould P.C.

(57) ABSTRACT

A gutter protection assembly includes a gutter and a gutter protection. The gutter includes a front wall, a bottom wall and a rear wall, the rear wall having a crimp protruding outwardly from an outer face of the rear wall of the gutter. The gutter protection device includes a front portion engageable with the front wall of the gutter, and a rear portion. The rear portion includes a gutter wall-engaging section having an outer downward segment provided with a hook. The hook is configured to engage with the crimp to provide a support for the gutter to hang from. The gutter assembly is securable to a supporting structure through an outwardly extending section projecting upwardly from the gutter wall-engaging section and extending above the rear wall of the gutter when in the gutter protection assembly, with the gutter hanging from the gutter protection device.

21 Claims, 15 Drawing Sheets

(56) References Cited

U.S. PATENT DOCUMENTS

| | | | | |
|---|---|---|---|---|
| 8,375,644 | B2 | 2/2013 | Robins | |
| 8,434,269 | B1 | 5/2013 | Brochu | |
| 8,479,454 | B2 | 7/2013 | Lenney et al. | |
| D723,671 | S | 3/2015 | Brochu | |
| 9,010,029 | B2 | 4/2015 | Higginbotham | |
| 2003/0110712 | A1 | 6/2003 | Brochu | |
| 2004/0118052 | A1 | 6/2004 | Brochu | |
| 2004/0182014 | A1 | 9/2004 | Brochu | |
| 2004/0244302 | A1 | 12/2004 | Neumann | |
| 2005/0028452 | A1 | 2/2005 | Brochu | |
| 2005/0115160 | A1 | 6/2005 | Brochu | |
| 2005/0193642 | A1 | 9/2005 | Brochu et al. | |
| 2005/0193671 | A1 | 9/2005 | Brochu et al. | |
| 2005/0223657 | A1 | 10/2005 | Brochu et al. | |
| 2005/0279036 | A1 | 12/2005 | Brochu | |
| 2006/0037254 | A1* | 2/2006 | Brochu | E04D 13/076 52/14 |
| 2006/0037255 | A1 | 2/2006 | Brochu | |
| 2006/0123710 | A1 | 6/2006 | Lenney et al. | |
| 2006/0283097 | A1 | 12/2006 | Gregg | |
| 2007/0167130 | A1 | 7/2007 | Brochu | |
| 2007/0169423 | A1 | 7/2007 | Brochu | |
| 2008/0010906 | A1* | 1/2008 | Brochu | E04D 13/076 52/12 |
| 2008/0163561 | A1 | 7/2008 | Lenney et al. | |
| 2008/0190039 | A1 | 8/2008 | Brochu | |
| 2008/0289263 | A1 | 11/2008 | Brochu | |
| 2009/0013612 | A1 | 1/2009 | Brochu | |
| 2009/0056234 | A1 | 3/2009 | Brochu | |
| 2009/0108144 | A1 | 4/2009 | Brochu | |
| 2010/0287846 | A1 | 11/2010 | Lenney | |
| 2011/0056145 | A1 | 3/2011 | Lenney et al. | |
| 2011/0067317 | A1 | 3/2011 | Hedrick | |
| 2011/0067318 | A1 | 3/2011 | Lenney et al. | |
| 2012/0151849 | A1 | 6/2012 | Brochu | |
| 2014/0069028 | A1 | 3/2014 | Lenney | |
| 2014/0215929 | A1 | 8/2014 | Lenney | |
| 2015/0020462 | A1* | 1/2015 | Iannelli | E04D 13/064 52/12 |
| 2015/0040488 | A1 | 2/2015 | Lenney | |
| 2015/0143756 | A1 | 5/2015 | Higginbotham | |
| 2015/0225959 | A1 | 8/2015 | Lenney | |
| 2015/0330085 | A1* | 11/2015 | Iannelli | E04D 13/064 52/12 |
| 2016/0369512 | A1 | 12/2016 | Lenney | |
| 2018/0030733 | A1* | 2/2018 | Brochu | E04D 13/076 |

FOREIGN PATENT DOCUMENTS

| | | | |
|---|---|---|---|
| CA | 2 458 005 | A1 | 8/2005 |
| CA | 2 458 006 | A1 | 8/2005 |
| CA | 2 460 429 | A1 | 9/2005 |
| CA | 2 541 186 | A1 | 7/2007 |
| CA | 2 593 808 | A1 | 1/2009 |
| CA | 2 608 530 | A1 | 4/2009 |
| CA | 2 727 844 | A1 | 7/2012 |
| CA | 2 747 513 | A1 | 1/2013 |
| CA | 2 783 834 | A1 | 8/2013 |
| CA | 2 775 864 | A1 | 11/2013 |
| CA | 2 863 023 | A1 | 3/2016 |
| CA | 2 747 704 | C | 4/2016 |
| EP | 1 449 980 | A1 | 8/2004 |
| EP | 1 627 974 | A2 | 2/2006 |
| EP | 2 159 342 | A1 | 3/2010 |
| EP | 2 177 685 | A1 | 4/2010 |
| GB | 2 481 033 | A | 12/2011 |
| WO | 2007/100320 | A1 | 9/2007 |
| WO | 2008/134845 | A1 | 11/2008 |

* cited by examiner

GUTTER PROTECTION DEVICE AND GUTTER PROTECTION ASSEMBLY

CROSS-REFERENCE TO RELATED APPLICATIONS

This application is a Divisional application of U.S. patent application Ser. No. 15/410,458, which claims priority under 35 USC § 119(e) of U.S. provisional patent application 62/280,310, the specification of which is hereby incorporated by reference.

TECHNICAL FIELD OF THE INVENTION

The technical field generally relates to gutter protection devices. More particularly, the technical field relates to a gutter protection device that prevents debris from entering the gutter on which the gutter protection device is mounted. It also relates to a gutter system including a gutter protection device.

BACKGROUND

Rain gutters are useful to collect rainwater that runs off the roof of a house or of a building and to route collected rainwater away from the foundation to a proper drainage area in order to avoid damages to the foundation, the soffit, the windows and/or the doors, for instance. Rain gutters generally include a trough channeling the rainwater to a downpipe or downspout, the trough being affixed to a supporting structure of the house or building such as the fascia board. To avoid the accumulation of leaves and other various debris in the trough of the gutter, a leaf guard may be retrofitted over the open top of the trough, for instance on a gutter already installed and affixed to the supporting structure. Gutter kits including both a trough and a leaf guard are also known in the art, and are intended to be installed as a combination.

However, leaves and debris may accumulate onto the surface of conventional leaf guards, which can prevent the rainwater from flowing into the trough. Thus, rainwater can flow over the leaf guard rather than into the trough and subsequently not reach the downpipe and accumulate near the foundation of the house or the building.

In view of the above, there is a need for improved rain gutters to overcome at least some of the drawbacks mentioned above.

BRIEF SUMMARY OF THE INVENTION

It is therefore an aim of the present invention to address the above-mentioned issues.

According to a general aspect, there is provided a gutter protection device for use in combination with a gutter, the gutter comprising a front wall, a bottom wall and a rear wall defining a trough having an open top, the front wall having an upper rim defining an inward recess. The gutter protection device comprises: a front portion, a central portion, and a rear portion, the front portion configured to contact the front wall of the gutter, at least one of the front portion and the central portion comprising a lower perforated section and an upper perforated plate, the upper perforated plate extending above the lower perforated section and being spaced-apart therefrom to define a water draining chamber inbetween when the gutter protection device is engaged with the gutter.

According to another general aspect, there is provided a gutter protection device for use in combination with a gutter, the gutter comprising a front wall, a bottom wall and a rear wall defining a trough having an open top. The gutter protection device comprises: a front portion engageable with the front wall of the gutter, a central portion and a rear portion. The rear portion comprises: a gutter wall-engaging section configured to engage with the rear wall of the gutter; and an upwardly extending wall projecting upwardly from the gutter wall-engaging section, the upwardly extending wall being substantially aligned with the rear wall of the gutter when the gutter protection device is engaged with the gutter.

According to still another general aspect, there is provided a gutter protection device for use in combination with a gutter. The gutter comprises a front wall, a bottom wall and a rear wall defining a trough having an open top. The gutter protection device comprises: a front portion engageable with the front wall of the gutter; a rear portion comprising a gutter wall-engaging section configured to engage with the rear wall of the gutter; and a central portion extending between the rear portion and front portion, the central portion extending from the rear portion at a height sufficient to create a downwardly oriented slope, the downwardly oriented slope directing rainwater away from the rear wall of the gutter when the gutter protection device is mounted to the gutter, with the gutter protection device preventing the front wall and the rear wall of the gutter from moving apart.

In an embodiment, the central portion is substantially planar.

According to a further general aspect, there is provided a gutter assembly comprising a gutter and a gutter protection device. The gutter comprises a front wall, a bottom wall and a rear wall, the rear wall comprising a plurality of crimps, the crimps protruding outwardly from an outer face of the rear wall of the gutter. The gutter protection device comprises: a front portion engageable with the front wall of the gutter, a central portion and a rear portion. The rear portion comprises: a gutter wall-engaging section comprising an outer downward segment provided with at least one hook configured to engage with the crimps protruding from the rear wall of the gutter thereby providing a support for the gutter to hang from.

According to a further general aspect, there is provided a gutter protection device for use in combination with a gutter. The gutter comprises a front wall, a bottom wall and a rear wall defining a trough having an open top, the front wall being connected to the rear wall close to the open top through a plurality of spaced-apart hangers. The gutter protection device comprises: a front portion, a rear portion, and a central portion extending between the front portion and the rear portion, the front portion contacting the front wall of the gutter when the gutter protection device is engaged with the gutter. The rear portion comprises a rearwardly biased gutter wall-engaging section extending downwardly from the central portion, the rearwardly biased gutter wall-engaging section being insertable in the trough when the gutter protection device is engaged with the gutter and being biased against an inner face of the rear wall of the gutter. The central portion has an excess width with respect to a width of the open top when the front portion contacts the front wall of the gutter and the wall-engaging section of the rear portion is biased against the inner face of the rear wall of the gutter to define a forced curvature therein.

According to still another general aspect, there is provided a gutter protection device for use in combination with a gutter. The gutter comprises: a front wall, a bottom wall and a rear wall defining a trough having an open top. The gutter protection device comprises: a front portion configured to contact the front wall of the gutter, a central portion and a rear portion. At least one of the front portion and the central portion comprises a recess defined at least partially by a lower perforated section; and a foam insert inserted in the recess, superposed to the lower perforated section, and at least partially filling the recess.

According to still another general aspect, there is provided a gutter protection device engageable with a gutter, the gutter including a front wall, a bottom wall and a rear wall defining a trough. The gutter protection device comprises a front portion, a single plate central portion, a rear portion and a longitudinal median line, the front portion and the rear portion being respectively engageable with the front wall and the rear wall of the gutter; a lower perforated section, extending solely in the front portion thereof and forwardly of the longitudinal median line, vertically spaced-apart from the single plate central portion, and an upper perforated plate extending above the lower perforated section and being spaced-apart therefrom to define a water draining chamber inbetween when the gutter protection device is engaged with the gutter.

In an embodiment, the lower perforated section defines at least partially a recess rearwardly of the front wall of the gutter, when the gutter protection device is engaged therewith.

In an embodiment, the front wall of the gutter further comprises an upper rim and a downwardly frontwardly extending flange extending from the upper rim to form a hook portion therewith, and the upper perforated plate comprises a free end insertable under and biasable against the downwardly frontwardly extending flange.

In an embodiment, the front wall of the gutter further comprises an upper rim and a downwardly frontwardly extending flange extending from the upper rim to form a hook portion therewith, and the front portion comprises, at a front end thereof, an upwardly extending segment projecting upwardly from the lower perforated section and an upper segment projecting upwardly and rearwardly from the upwardly extending segment, the upper segment being configured to engage with the hook portion of the front portion of the gutter protection device, and the upper perforated plate comprising a free end insertable under and biasable against the downwardly frontwardly extending flange.

In an embodiment, when the free end of the upper perforated plate is inserted under the downwardly frontwardly extending flange, the upper perforated plate defines a downwardly frontwardly oriented slope to direct rainwater in the water draining chamber.

In an embodiment, the central portion, adjacent to the front portion, comprises an S-shaped portion defining a plate-engaging groove, the lower perforated section extending downwardly from the S-shape portion.

In an embodiment, a rear end of the upper perforated plate is inserted in the plate-engaging groove of the S-shaped portion and extends above the lower perforated section.

In an embodiment, the front portion further comprises two recess segments extending upwardly from a respective one of longitudinal ends of the lower perforated section and defining therewith the recess in the front portion of the gutter protection device and wherein the recess is wider adjacent to the lower perforated section.

In an embodiment, wherein the upper perforated plate is engaged with, extends partially under the recess segments, and biasable against the recess segments.

In an embodiment, the upper perforated plate defines an outward curvature.

In an embodiment, the central portion is substantially through hole free, defines a generally downwardly frontwardly oriented slope from the rear portion towards the front portion to direct rainwater away from the rear wall of the gutter, and includes a section that extends forwardly of the longitudinal median line.

In an embodiment, the central portion is generally planar and further comprises longitudinally extending reinforcing ribs.

In an embodiment, the upper perforated plate comprises mesh.

According to still another general aspect, there is provided a gutter protection device engageable with a gutter, the gutter including a front wall, a bottom wall and a rear wall defining a trough. The gutter protection device comprises a front portion engageable with the front wall of the gutter and a rear portion. The rear portion comprises a gutter wall-engaging section engageable with the rear wall of the gutter to form a gutter assembly when the front portion and the gutter wall-engaging section are respectively engaged with the front wall and the rear wall of the gutter; and an upwardly extending section projecting upwardly from the gutter wall-engaging section and extending above the rear wall of the gutter in the gutter assembly, the gutter assembly being securable to a supporting structure through the upwardly extending section with the gutter hanging from the gutter protection device.

In an embodiment, the gutter wall-engaging section comprises an inner downward segment and an outer downward segment defining a channel thereinbetween to receive an upper end of the rear wall of the gutter therein.

In an embodiment, the upwardly extending section extends continuously and upwardly from the central portion.

In an embodiment, the upwardly extending section further comprises a plurality of spaced-apart fasteners holes extending therethrough to receive fasteners to secure the gutter protection device to a supporting structure, the fasteners holes extending above the rear wall of the gutter in the gutter assembly.

In an embodiment, the upwardly extending section, the inner downward segment and the outer downward segment are made of a folded single material plate.

According to still another general aspect, there is provided a gutter protection assembly comprising a gutter and a gutter protection device. The gutter comprises a front wall, a bottom wall and a rear wall. The rear wall comprises at least one crimp protruding outwardly from an outer face of the rear wall of the gutter. The gutter protection device comprises a front portion engageable with the front wall of the gutter and a rear portion comprising a gutter wall-engaging section comprising an outer downward segment provided with at least one hook configured to engage with the at least one crimp protruding from the rear wall of the gutter thereby providing a support for the gutter to hang from.

In an embodiment, the at least one crimp has a substantially semi-hemispheric shape.

In an embodiment, the at least one crimp comprises a plurality of longitudinally spaced-apart crimps.

In an embodiment, the plurality of crimps is provided at a substantially constant height with respect to an upper edge of the rear wall.

In an embodiment, the at least one hook comprises an inner fold protruding inwardly and upwardly from the outer downward segment.

In an embodiment, the at least one hook comprises a continuous hook extending along a length of the outer downward segment defined between two longitudinally spaced-apart ends thereof.

In an embodiment, the at least one hook is configured to engage with the at least one crimp to permit translational movements between the gutter and the gutter protection device along a longitudinal axis.

According to still another general aspect, there is provided a gutter protection device engageable with a gutter, the gutter including a front wall, a bottom wall and a rear wall defining a trough having an open top. The gutter protection device comprises a front portion engageable with the front wall of the gutter; a rear portion comprising a gutter wall-engaging section configured to engage with the rear wall of the gutter; and a central portion extending between the rear portion and front portion, the central portion extending from the rear portion at a height sufficient to create a downwardly oriented slope, the downwardly oriented slope directing rainwater away from the rear wall of the gutter when the gutter protection device is mounted to the gutter, with the gutter protection device preventing the gutter from widening at the open top.

In an embodiment, the central portion is substantially planar.

In an embodiment, the central portion forms an angle of between 60° and 90° relative to the rear wall of the gutter.

According to still another general aspect, there is provided a gutter protection device engageable with a gutter, the gutter including a front wall, a bottom wall, a rear wall defining a trough having an open top, and a plurality of spaced-apart hangers extending between and connecting the front wall and the rear wall close to the open top. The gutter protection device comprises a front portion, a rear portion, and a central portion extending between the front portion and the rear portion, the front portion contacting the front wall of the gutter when the gutter protection device is engaged with the gutter; the rear portion comprising a rearwardly biasable gutter wall-engaging section extending downwardly from the central portion, the rearwardly biasable gutter wall-engaging section being inserted in the trough when the gutter protection device is engaged with the gutter; the central portion having an excess width with respect to a width of the open top when the front portion contacts the front wall of the gutter and the wall-engaging section of the rear portion is biased towards the inner face of the rear wall of the gutter to define a forced curvature therein.

In an embodiment, the rearwardly biasable gutter wall-engaging section is biasable against one of an inner face of the rear wall of the gutter and an outer face of one of the plurality of spaced-apart hangers.

In an embodiment, the rear portion further comprises a sealing element receiving channel; and the gutter protection device further comprises a sealing element having a section inserted in the sealing element receiving channel and another section protruding outwardly therefrom and rearwardly from the gutter protection device, the sealing element being configured to abut a supporting surface of a supporting structure when the gutter protection device is engaged with the existing gutter.

In an embodiment, the front portion comprises a lower perforated section.

In an embodiment, the lower perforated section defines at least partially a recess, rearwardly of the front wall of the gutter, when the gutter protection device is engaged therewith.

In an embodiment, the front portion further comprises two recess segments extending upwardly from a respective one of longitudinal ends of the lower perforated section and defining therewith the recess in the front portion and wherein the recess is wider adjacent to the lower perforated section.

In an embodiment, the gutter protection device further comprises a foam insert inserted in the recess, superposed to the lower perforated section, the foam insert at least partially filling the recess.

According to still another general aspect, there is provided a gutter protection device engageable with a gutter, the gutter including a front wall, a bottom wall and a rear wall defining a trough having an open top. The gutter protection device comprises a front portion configured to contact the front wall of the gutter and a rear portion, the front portion comprising a lower perforated section defining at least partially a recess; and a foam insert inserted in the recess, superposed to the lower perforated section, and at least partially filling the recess.

In an embodiment, the gutter protection device further comprises a central portion extending between the front and the rear portion with the foam insert extending below the central portion of the gutter protection device.

In an embodiment, the foam insert has a shape substantially matching to a shape of the recess.

In an embodiment, the foam insert comprises a plastic open-cell foam material.

According to still another general aspect, there is provided a gutter assembly comprising a gutter and a gutter protection device. The gutter includes a front wall, a bottom wall and a rear wall defining a trough. The gutter protection device comprises a front portion, a single plate central portion, a rear portion and a longitudinal median line, the front portion and the rear portion being respectively engageable with the front wall and the rear wall of the gutter. The gutter protection device also comprises, solely in the front portion thereof and forwardly of the longitudinal median line; and a lower perforated section, vertically spaced-apart from the single plate central portion and extending forwardly thereof, and an upper perforated plate extending above the lower perforated section and being spaced-apart therefrom to define a water draining chamber inbetween when the gutter protection device is engaged with the gutter.

According to still another general aspect, there is provided a gutter protection assembly comprising a gutter and a gutter protection device. The gutter includes a front wall, a bottom wall and a rear wall defining a trough. The gutter protection device comprises a front portion engageable with the front wall of the gutter and a rear portion. The rear portion comprises a gutter wall-engaging section engageable with the rear wall of the gutter to form a gutter assembly when the front portion and the gutter wall-engaging section are respectively engaged with the front wall and the rear wall of the gutter; and an upwardly extending section projecting upwardly from the gutter wall-engaging section and extending above the rear wall of the gutter in the gutter assembly, the gutter assembly being securable to a supporting structure through the upwardly extending section with the gutter hanging from the gutter protection device.

BRIEF DESCRIPTION OF THE DRAWINGS

It will be noted that throughout the appended drawings, like features are identified by like reference numerals.

DETAILED DESCRIPTION

Figure 1:
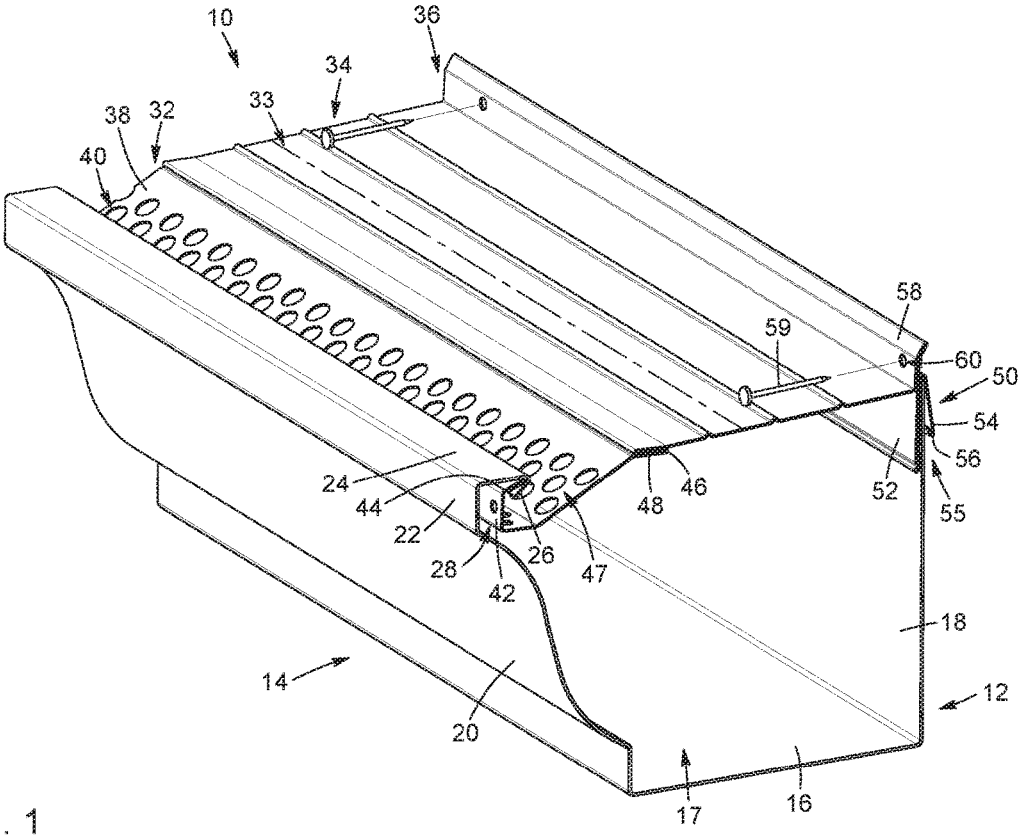
FIG. 1 is a side perspective view of a section of a gutter protection device mounted on a section of a gutter.

In the following description, there is described various embodiments related to a gutter protection device engageable with a gutter. As will be readily understood by one skilled in the art, the gutter protection device and the gutter according to the embodiments presented herein and equivalents thereto may be provided separately or in combination. In some embodiments, a gutter protection device configured to be used with a gutter having crimps protruding outwardly from a rear wall of the gutter or the like is provided. Such combination may or may not be commercialized as a kit to be assembled. In another embodiment, a gutter protection device that may be commercialized as a standalone component to fit over a traditional gutter is provided.

Although the embodiments of the gutter protection device and the gutter and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the gutter protection device and the gutter, as will be briefly explained herein and as can be easily inferred herefrom by a person skilled in the art.

Moreover, it will be appreciated that positional descriptions such as "downwardly", "rearwardly", "frontwardly", "upper", "outer" and the like should be taken in the context of the figures only and should not be considered limiting. More particularly, they correspond to the position and orientation of the gutter, when mounted to a supporting surface of a supporting structure, and the gutter protection device when engaged with the gutter. The rear position corresponds to portions adjacent to the supporting surface while the front position corresponds to portions opposed to the supporting surface. The inner position corresponds to portions/surfaces facing the gutter trough while the outer position corresponds to portions/surfaces facing outwardly.

Having discussed the general context of the gutter protection device engageable with a gutter, optional embodiments will be discussed further hereinbelow. The embodiments according to the following description are given for exemplification purposes only.

Referring to FIGS. 1 to 5, a gutter protection device (10) in combination with a gutter (12) is shown. The gutter protection device (10) shown in FIGS. 1 to 5 is designed to be preassembled with the gutter (12) and then, secured to a supporting surface of a supporting structure, such as a wall and the like, as an assembly with the gutter (12). The gutter (12) and the gutter protection device (10) may be made of metal, plastic or other rigid material and combinations thereof that would be suitable for the embodiments described herein.

The gutter (12) includes a front wall (14) and a rear wall (18) extending upwardly from a bottom wall (16) to define a trough (17) having an open top (19). In the embodiment shown, the front wall (14) of the gutter (12) includes, successively, an outwardly inclined segment (20), an upright segment (22), an upper rim (24) and a downwardly frontwardly extending flange (26). The succession of the upright segment (22), the upper rim (24) and the downwardly frontwardly extending flange (26) forms an inward recess (28). In turn, the upper rim (24) and the downwardly frontwardly extending flange (26) form a hook portion (45) projecting in the inward recess (28). It will be understood that the hook portion (45) can be designed with different angles or shapes to allow a front portion (32) of the gutter protection device (10) to be received within the inward recess (28) and to contact and, more particularly, engage with the hook portion (45), as will be described in more details below. It is appreciated that the inward recess (28) may also be of variable dimensions, as long as it permits a portion of the gutter protection device (10) to extend at least partially below the upper rim (24). It is appreciated that the shape of the front wall (14) can vary from the embodiment described above in reference to FIGS. 1 to 5.

In the embodiment shown, the rear wall (18) of the gutter (12) is substantially straight and includes an outer face (29) superposable to a supporting surface (not shown) of a supporting structure, such as a wall and the like. The rear wall (18) of the gutter (12) includes a plurality of longitudinally spaced-apart crimps (30) protruding outwardly from the outer face (29) of the rear wall (18) of the gutter, or a plurality of any other types of protuberance or equivalent structures that would allow a hook to engage therewith, as will be described in more details below. In the embodiment shown, the crimps (30) are provided at a substantially constant height with respect to an upper edge of the rear wall (18), in an upper section thereof, and have a substantially semi-hemispheric shape.

Still referring to FIGS. 1 to 5, the gutter protection device (10), engageable with the gutter (12), includes a front portion (32), a central portion (34), a rear portion (36) and a longitudinal median line (33). The front portion (32) and the rear portion (36) are respectively engageable with the front wall (14) and the rear wall (18) of the gutter (12). The central portion (34) extends between the front portion (32) and the rear portion (36). In the embodiment shown, the central portion (34) is a single plate (i.e. the central portion (34) includes a single material layer) that is substantially planar and through hole free, and includes a plurality of longitudinally extending reinforcing ribs. It is appreciated that the height of the longitudinally extending reinforcing ribs is relatively small in comparison to the height of the front portion (32) and the rear portion (36) and thus, the longitudinally extending reinforcing ribs do not modify the overall planar profile of the central portion (34). In the embodiment shown, the gutter protection device (10) is a single piece in that it is made of a single plate bent to define the different sections and features. However, it is appreciated that, in an alternative embodiment, it can be made of a plurality of components secured together.

When engaged with the gutter (12), the gutter protection device (10) substantially closes the open top (19) of the gutter (12), except for the through holes defined therein, and substantially prevent debris accumulation into the trough (17).

The gutter protection device (10) includes, solely in the front portion (32) thereof and forwardly of the longitudinal median line, a lower perforated section (38) vertically spaced-apart from the central section (34) and extending forwardly therefrom, provided with a plurality of lower through holes (40). It is to be noted that the proportion of the front portion (32) relative to the central portion (34) can vary from the one shown in the illustrated embodiment to be engageable with the front wall (14) of a corresponding gutter (12). The lower through holes (40) may be of variable diameters and variable patterns to allow the water to go through while preventing at least some particles to pass therethrough and accumulate in the trough of the gutter (12). In the embodiment shown, the front portion (32) includes, at a front end thereof, an upwardly extending segment (42) projecting upwardly from the lower perforated section (38) and an upper segment (44) projecting upwardly and rearwardly from the upwardly extending segment (42). In an embodiment, a bight (not shown) can extend from the upwardly extending segment (42) and be superposed thereto. The upper segment (44) is configured to be inserted in the inward recess (28) and engage with the hook portion (45) in order to engage the front portion (32) of the gutter protection device (10) to the front wall (14) of the gutter (12). In the embodiment shown, the central portion (34), adjacent to the front portion (32), also includes an S-shaped portion (46) defining a plate-engaging groove (48). In this embodiment, the S-shaped portion (46) extends above the lower perforated section (38) and connects the lower perforated section (38) to the central portion (34). It is appreciated that the connection between the lower perforated section (38) and the central portion (34) can differ from the S-shaped portion (46) described above. Furthermore, in an alternative embodiment, the front portion (32) and the central portion (34) can be made of two or more distinct components secured together, for instance through fasteners or welding.

It is appreciated that the shape of the lower perforated section (38) can differ from the shape shown in the Figures. For instance and without being limitative, instead of including an inclined section connected to the S-shaped portion (46), or any other suitable connection, the lower perforated section (38) can include a first segment extending substantially vertically and a second segment extending substantially horizontally towards the upwardly extending segment (42).

Still referring to FIGS. 1 to 5, the rear portion (36) of the gutter protection device (10) includes a gutter wall-engaging section (50), or gutter wall-contacting section, which in turn includes an inner downward segment (52) and an outer downward segment (54) defining a channel (55) inbetween. This channel (55) allows the rear portion (36) of the gutter protection device (10) to receive an upper section of the rear wall (18) of the gutter (12) therein. The outer downward segment (54) includes a hookable portion (56) configured to engage with the crimps (30) protruding outwardly from the outer face (29) of the rear wall (18). In the illustrated embodiment of FIGS. 1 to 5, the hookable portion (56) is a continuous hook located alongside the length of the outer downward segment (54) defined between the two spaced-apart longitudinal ends thereof. In some implementations, the hookable portion (56) can include individual spaced-apart hooks. In the embodiment shown, the hookable portion (56) is an inner fold protruding inwardly and upwardly from the outer downward segment (54).

The rear portion (36) also includes an upwardly extending section (58) projecting upwardly from the gutter wall-engaging section (50). In the embodiment shown, the upwardly extending section (58), the inner downward segment (52) and the outer downward segment (54) are made of a folded single material plate. Still in the embodiment shown, the upwardly extending section (58) is adjacent to the central portion (34) of the gutter protection device (10) and extends continuously and upwardly therefrom. It is to be appreciated that, in another embodiment (not shown), the upwardly extending section (58) can extend upwardly from the inner downward segment (52) and the outer downward segment (54) to form a bight at an upper end thereof such that the upper end of the rear wall (18) of the gutter (12) can abut the bight when the gutter protection device (10) is engaged with the gutter (12). When engaged with the gutter (12), the upwardly extending section (58) extends above the rear wall (18) of the gutter (12). Furthermore, in the embodiment shown, the upwardly extending section (58) is positioned substantially aligned with the rear wall (18) of the gutter (12), slightly in front, when the gutter protection device (10) is engaged with the gutter (12). In this embodiment, the gutter (12) and the gutter protection device (10) define a gutter assembly securable to a supporting surface of a supporting structure through the upwardly extending section (58), with the gutter hanging from the gutter protection device.

The upwardly extending section (58) optionally includes fastener holes (60) through which mechanical fasteners (59) such as screw or nails can be received to fix an assembly including the gutter (12) and the gutter protection device (10) directly to a supporting structure of a supporting structure, such as a wall and the like, as will be described in more details below. When the gutter protection device (10) is engaged with the gutter (12), the fastener holes (60) extend above the gutter (12). Thus, the fasteners securing the gutter (12) and gutter protection device (10) assembly to the supporting surface do not extend through the rear wall (18) of the gutter (12), as will be described in more details below. When fastener holes (60) are absent, a variety of means can also be used to fix the assembly to the supporting structure.

Figure 2:
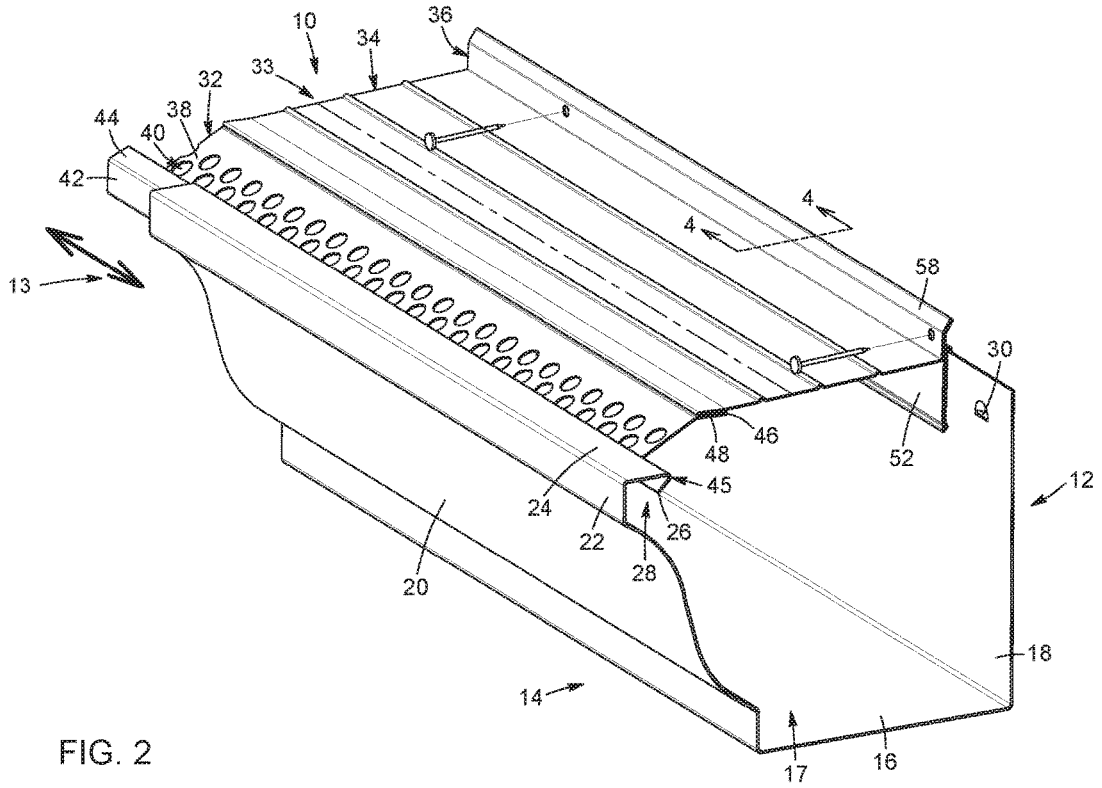
FIG. 2 is a side perspective view of the gutter protection device and the gutter of FIG. 1 when the gutter protection device is translated towards the left with respect to the gutter.
Figures 3, 3A:
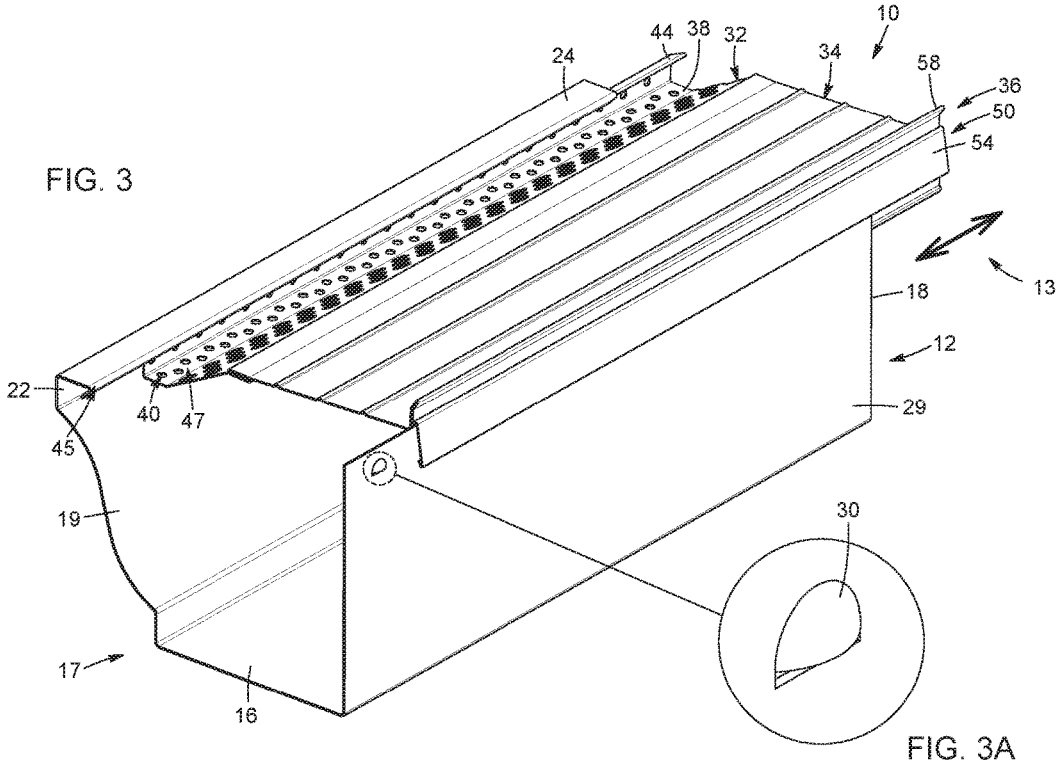
FIG. 3 is a rear perspective view of the gutter protection device and the gutter of FIG. 2 illustrating a crimp protruding from a rear wall of the gutter.
FIG. 3A is an enlarged side perspective view of the crimp protruding from the rear wall of the gutter shown in FIG. 3.
Figure 4:
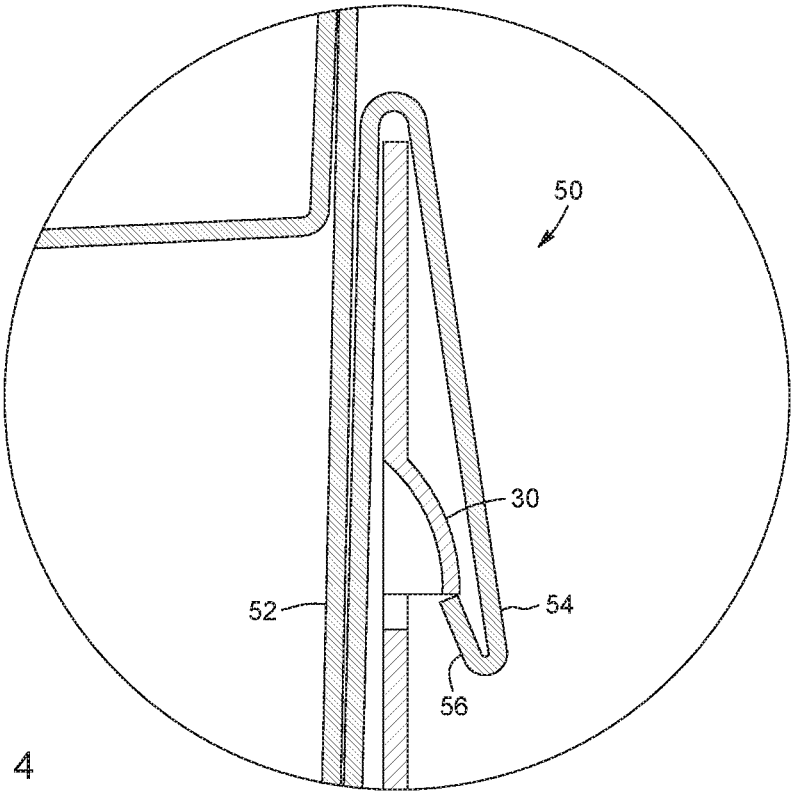
FIG. 4 is a cross-sectional view, enlarged, of the crimp protruding from the rear wall of the gutter shown in FIG. 3 and a hook of the gutter protection device.

As mentioned above, the gutter protection device (10) shown in FIGS. 1 to 5 is engaged with the gutter (12) to form an assembly prior to securing the assembly to a supporting structure of a supporting structure. Also, as mentioned above, the front portion (32) of the gutter protection device (10) is engaged with the front wall (14) of the gutter (12) by inserting the upper segment (44) in the inward recess (28) of the gutter (12) to engage the hook portion (45). Engagement between the rear portion (36) of the gutter protection device (10) with the rear wall (18) of the gutter (12) is provided through engagement of the outer downward segment (54) with the crimps (30) protruding outwardly from the rear wall (18) of the gutter (12), as shown in FIG. 4.

It is appreciated that, in an alternative embodiment (not shown), the rear portion (36) of the gutter protection device (10) may also include a variety of connectors configured and positioned to connect the gutter protection device (10) to the gutter (12) to form the assembly.

Following engagement between the front portion (32) and the rear portion (36) of the gutter protection device (10) and respectively the front wall (14) and the rear wall (18) of the gutter (12), the assembly can be supported by the gutter protection device (10) wherein the gutter (12) hangs from the gutter protection device (10). In this illustrated embodiment, the gutter protection device (10) can then be fixed to a supporting surface of a supporting structure, such as a wall, with the gutter (12) hanging below the gutter protection device (10). As mentioned above, the gutter protection device (10) is secured to the supporting surface by inserting mechanical fasteners (59) simultaneously into the upwardly extending section (58) and the supporting surface, above the rear wall (18) of the gutter (12) when the gutter (12) and the gutter protecting device (10) are engaged together. In this embodiment, the upwardly extending section (58) extends above the rear wall (18) of the gutter (12) at a height sufficient to receive the mechanical fasteners (59) therein without contacting the rear wall (18) of the gutter (12), thereby allowing free translation between the gutter (12) and the gutter protection device (10).

Thus, the gutter (12) is not secured directly to the supporting surface but engaged therewith through the gutter protection device (10). Consequently, translational movements between the gutter (12) and the gutter protection device (10) along a longitudinal axis (13) are allowed, for instance during thermal expansion and contraction. FIG. 2 shows the translational movement of the gutter (12) relative to the gutter protection device (10).

The central portion (34) extends forwardly from the upwardly extending section (58), which in turn extends above the rear wall (18) of the gutter (12). In some embodiments, the gutter protection device (10) defines a generally downwardly oriented slope from the rear portion (36) towards the front portion (32), except for the longitudinally extending reinforcing ribs defined in the central portion (34), when the gutter protection device (10) is engaged with the gutter (12). For instance, in an embodiment, the central portion (34) forms an angle of between 60° and 90° relative to the rear wall (18) of the gutter (12). The downwardly oriented slope directs the rainwater away from the rear wall (18) of the gutter (12) and, more particularly, away from the supporting surface when the gutter (12) and the gutter protection device (10) are secured thereto. Furthermore, in the embodiment shown, the central portion (34) is free of apertures to facilitate the movement of the rainwater away from the rear wall (18) of the gutter (12) and towards the front portion (32) of the gutter protection device (10).

Figure 5:
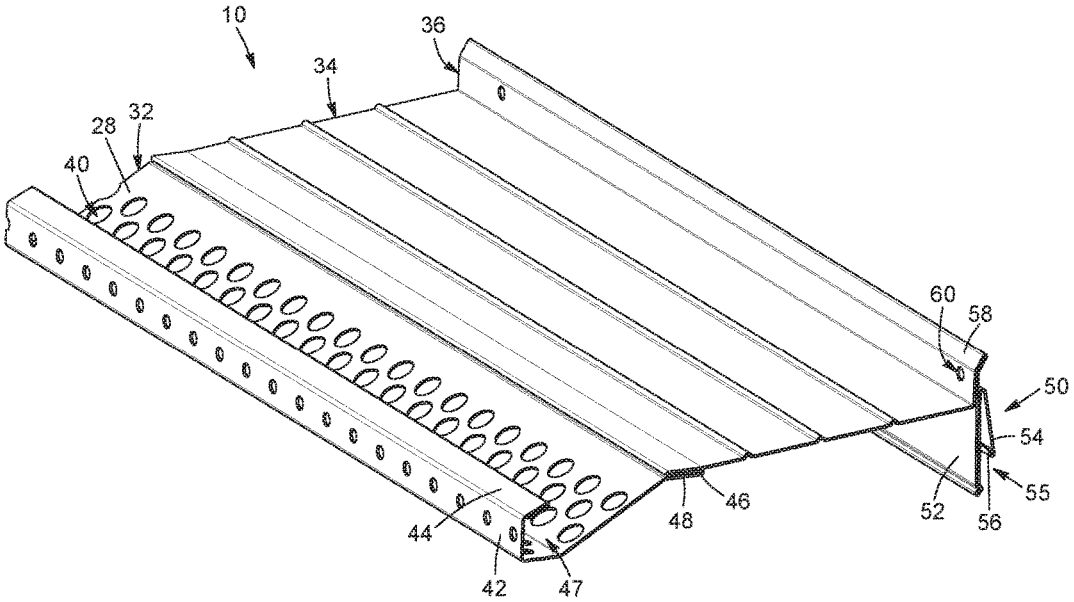
FIG. 5 is a side perspective view of the gutter protection device shown in FIG. 1.

As shown in FIGS. 1, 3, and 5, a recess (47) is defined in the front portion (32) of the gutter protection device (10) by the lower perforated section (38), between the central portion (34) and the hook portion (45) or the upwardly extending segment (42). In the illustrated embodiment, the recess (47) extends below the central portion (34) of the gutter protection device (10). In an embodiment (not shown), the recess (47) can be at least partially filled with a foam insert. When inserted in the recess (47), the foam insert can extend below the central portion (34) of the gutter protection device (10). The shape of the foam insert can substantially match the shape of the recess (47) or can differ therefrom. For instance, the foam insert can be made of several suitable materials including a plastic open-cell foam material such as an open pore polyether foam like the gutter foam filter Gutter Stuff™.

Figure 6:
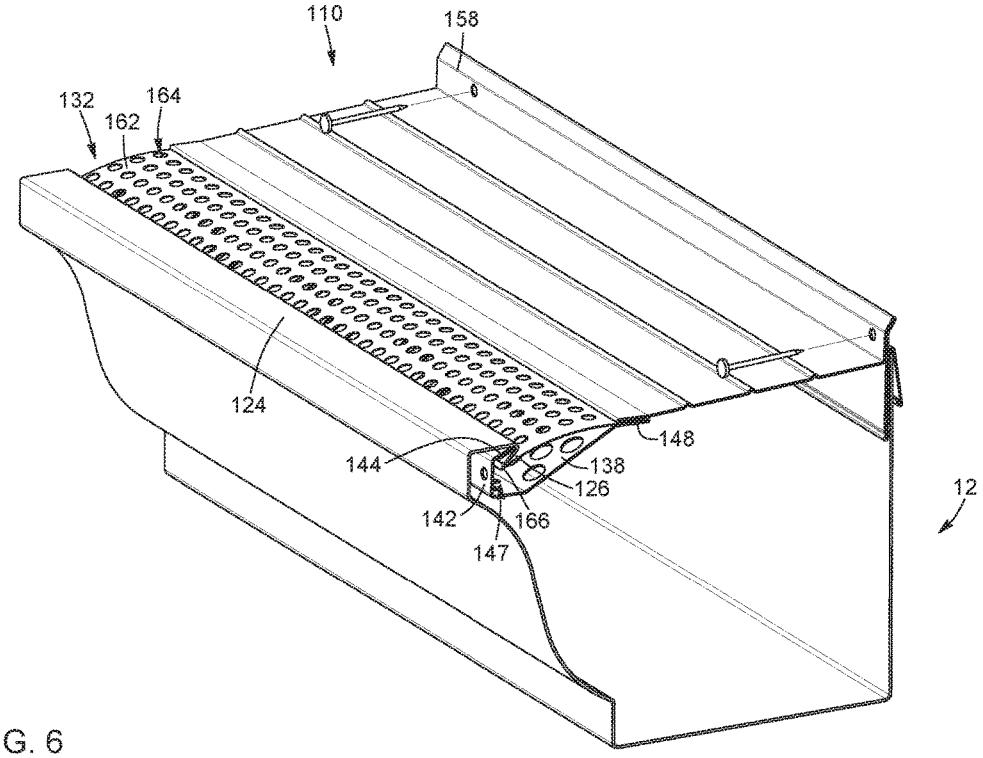
FIG. 6 is a side perspective view of a gutter protection device mounted on a gutter in accordance with another embodiment wherein the gutter protection device includes an upper perforated plate and a lower perforated section.
Figures 7, 7A:
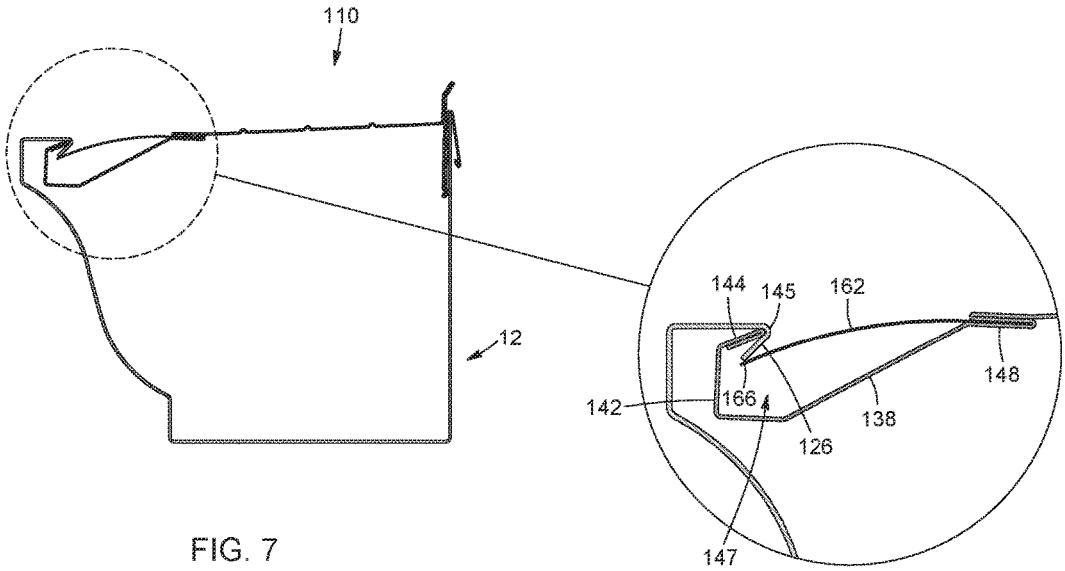
FIG. 7 is a side elevation view of the gutter protection device and the gutter of FIG. 6, showing the upper perforated plate and the lower perforated section of the gutter protection device.
FIG. 7A is a close-up side elevation view of the upper perforated plate and the lower perforated section shown in FIG. 7.

Referring to now FIGS. 6 and 7, there is shown an alternative embodiment of the gutter protection device (110) in combination with the gutter (12) wherein the features of the gutter protection device (110) are numbered with reference numerals in the 100 series which correspond to the reference numerals of the previous embodiment. The features of the gutter protection device (110) are similar to the features of the gutter protection device (10). The front portion (132) of the gutter protection device (110) further includes, in addition to the lower perforated section (128), an upper perforated plate (162) that includes a plurality of upper through holes (164) allowing a minimum quantity of water to go through without accumulating thereon. The plate can be made of metal, plastic or any other suitable material. The upper perforated plate (162) is located above the lower perforated section (138), spaced-apart therefrom. In the embodiment shown, a free end (166) of the upper perforated plate (162) is inserted under and biased against the downwardly frontwardly extending flange (126) of the gutter (12), when engaged therewith. Such arrangement of the upper perforated plate (162) above the lower perforated section (138) defines a water draining chamber when the front portion (132) of the gutter protection device (110) is engaged with the gutter (12). In the embodiment shown, the upper perforated plate (162) defines a downwardly frontwardly oriented slope to direct rainwater in the water draining chamber. In the implementation shown, a rear end of the upper perforated plate (162) is inserted in the plate-engaging groove (148) to be secured to the front portion (132) of the gutter protection device (110). Equivalent connectors could also be used to secure the upper perforated plate (162) to the front portion (132).

When the gutter protection device (110) is mounted to the gutter (12), the upper perforated plate (162) can prevent debris from accumulating in the recess defined by the combination of the lower perforated section (138), the upwardly extending segment (142) and the upper segment (144). Therefore, the upper perforated plate (162) closes the recess and can prevent debris accumulation while permitting the water to be drained efficiently. In case of leaf accumulation over the front portion (132) of the gutter protection device (110), the plurality of lower through holes (140) and/or upper through holes (164) and a substantially alignment between the upper perforated plate (162) and the upper rim (124) of the gutter (12) may allow the leaves to dry and be blown away by the wind, thereby freeing the gutter protection device (110) from potentially obstructing debris.

In an embodiment, the upper perforated plate (162) can be a wire mesh plate or any other suitable layer comprising through holes allowing a minimum quantity of water to go through without accumulating thereon. Once again, it is appreciated that the shape of the lower perforated section (138) can differ from the shape shown in the Figures.

Figure 8:
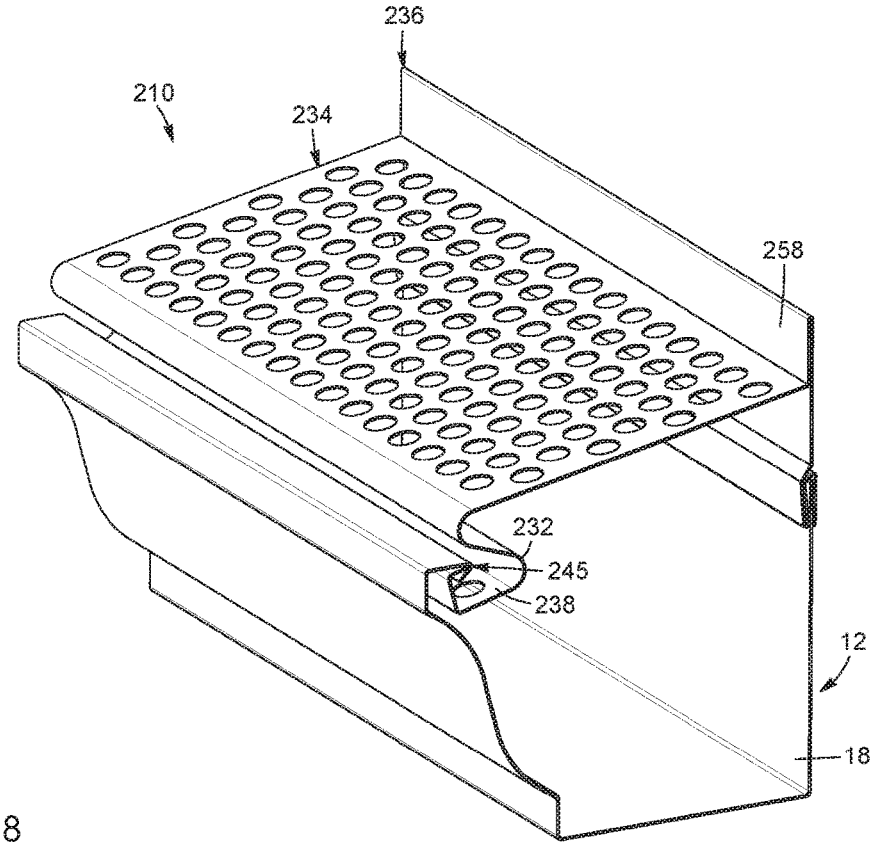
FIG. 8 is a side perspective view of a gutter protection device mounted on a gutter in accordance with another embodiment.

Turning now to FIG. 8, there is shown an alternative embodiment of the gutter protection device (210) in combination with the gutter (12) wherein the features of the gutter protection device (210) are numbered with reference numerals in the 200 series which correspond to the reference numerals of the previous embodiments. In the embodiment shown in FIG. 8, the lower perforated section (238) of the gutter protection device (210) is characterized by an inverse S-shape, showing that the shape of front portion (32, 132, 232) engaging with the hook portion (45, 145, 245) can vary. The embodiment of FIG. 8 also shows that alternatively, the height of the upwardly extending section (258) may be higher, and the height at which the central portion (234) of the gutter protection device (210) extends from the upwardly extending section (258) may also be higher than the upwardly extending section (58, 158) shown in FIGS. 1 to 3 and 4 to 7. More particularly, in the embodiment shown, a rear end of the central portion (234) is connected to the rear portion (236) above an upper end of the rear wall (18) of the gutter (12) when the gutter protection device (210) is engaged therewith. Furthermore, in the embodiment shown, the upwardly extending section (258) is substantially aligned with the rear wall (18) of the gutter (12) when the gutter protection device (210) is engaged with the gutter (12). It will be appreciated by the person skilled in the art that the higher the central portion (234) extends above the rear wall (18) of the gutter (12), the steepest the downwardly oriented slope of the central portion (234) extending between the front portion (232) and the rear portion (236) will be. As mentioned above, the downwardly oriented slope of the gutter protection device (210) directs the rainwater away from the rear wall (18) of the gutter (12) and away from the supporting surface to which the gutter (12) and the gutter protection device (210) assembly is secured.

In the assemblies illustrated in FIGS. 1 to 8, the front portion (32, 132, 232) and the rear portion (36, 136, 236) of the gutter protection devices (10, 110, 210) are respectively engaged with the front wall (14) and the rear wall (18) of the gutter (12) and thereby prevent the front wall (14) and the rear wall (18) of the gutter (12) from spreading apart, for example if water freezes therein and the subsequently formed ice leads to an unwanted expansion of the trough.

Figure 9:
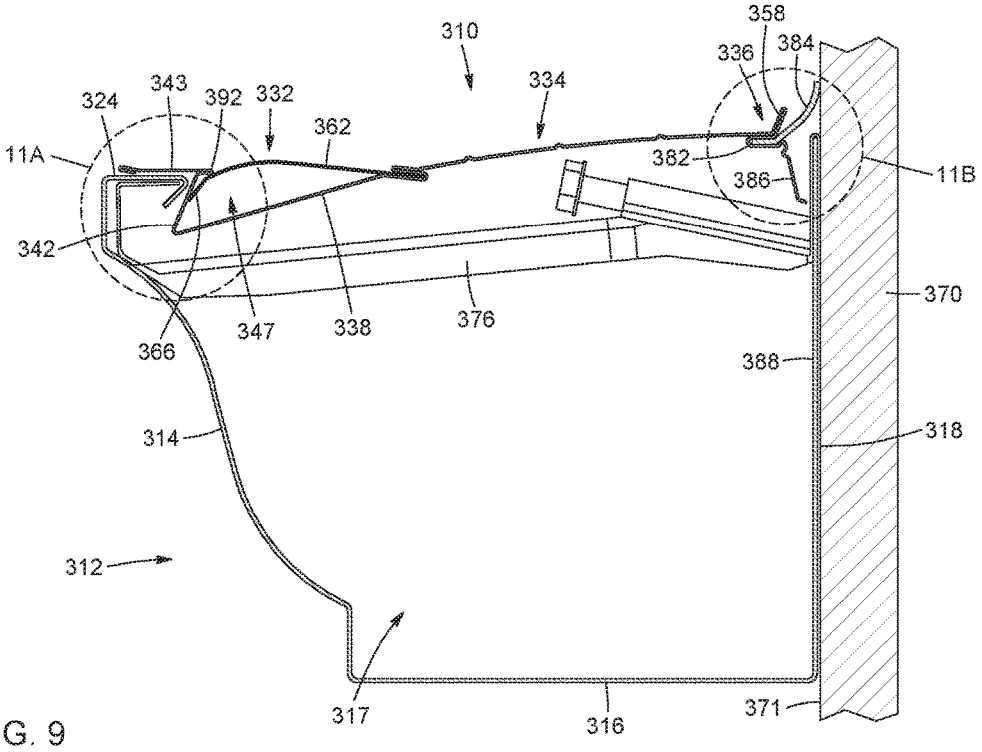
FIG. 9 is a side elevation view of a gutter protection device mounted on a gutter in accordance with another embodiment, wherein the gutter protection device is engaged with the gutter once the gutter is secured to a supporting surface of a supporting structure.
Figure 10:
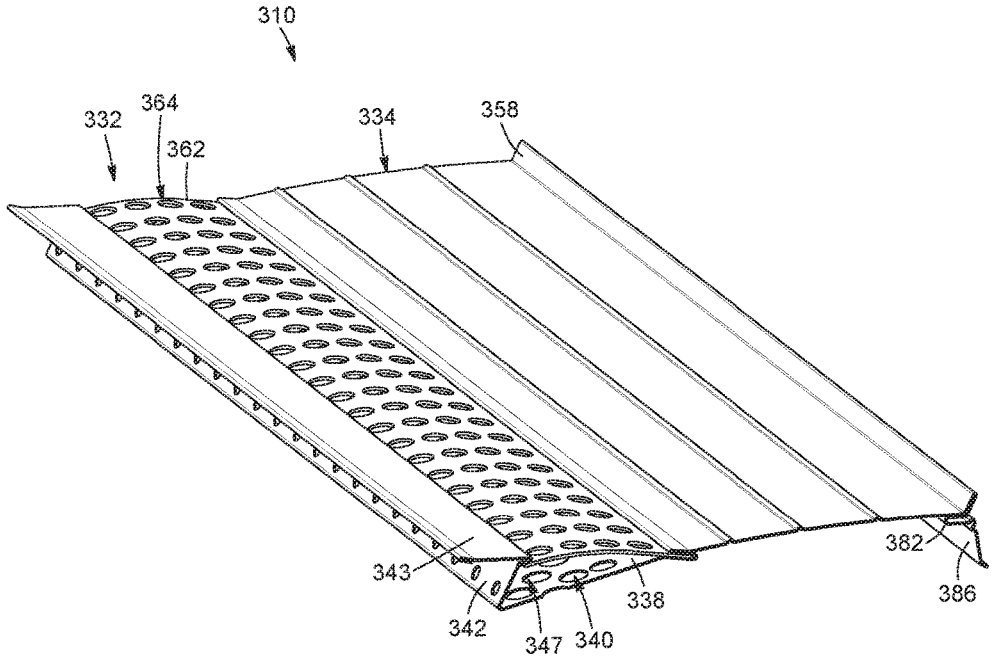
FIG. 10 is a side perspective view of the gutter protection device of FIG. 9.
Figure 11A:
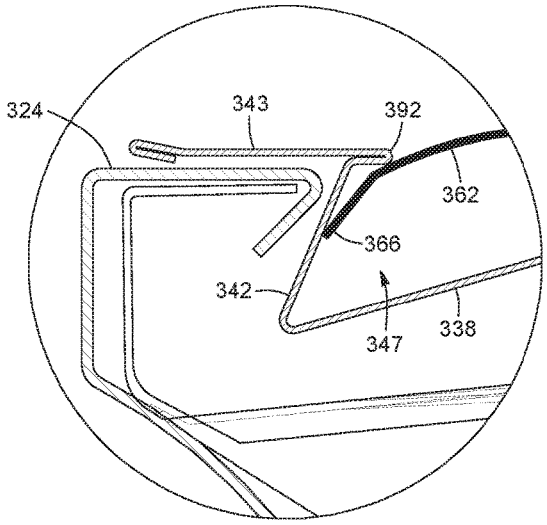
FIG. 11A is a close-up side elevation view of a front portion of the gutter protection device of FIG. 9

Referring now to FIGS. 9 to 11, a gutter protection device (310) that may be installed over an existing gutter (312) is shown wherein the features of the gutter protection device (310) are numbered with reference numerals in the 300 series which correspond to the reference numerals of the previous embodiments. The existing gutter (312) is a gutter already mounted to a supporting surface of a supporting structure to which a gutter protection device is subsequently added. In this embodiment, the gutter (312) includes a front wall (314), a bottom wall (316) and a rear wall (318) defining a trough (317) having an open top. The front wall (314) is connected to the rear wall (318) through a plurality of spaced-apart hangers (376) secured near the open top of the existing gutter (312). The spaced-apart hangers (376) allow the gutter (312) to be fixed to the supporting surface, and also prevent the front wall (314) and the rear wall (318) of the gutter (312) from spreading apart from each other. It is appreciated that the existing gutter (312) may also be connected to the supporting surface through equivalent structures. In this specification, the term "hanger" is intended to mean any mechanical device that secures the gutter to the supporting surface. In an embodiment, the hangers (376) can be mechanical fasteners, such as nails, extending sequentially through the front wall (314) and the rear wall (318) of the gutter (312), and the supporting surface. Hangers includes spikes and ferrules, snap-lock hangers, hidden hangers, and the like.

The gutter protection device (310) includes a front portion (332), a rear portion (336), and a central portion (334), the central portion (334) extending between the front portion (332) and the rear portion (336). The front portion (332) is configured to contact the front wall of the existing gutter (312) when the gutter protection device (310) is mounted over the gutter (312) to cover the open top. In contrast with the embodiment shown in FIGS. 1 to 4, the gutter protection device (310) shown in the embodiment of FIGS. 9 to 11 has no upper segment (44) engaging with a hook portion, as the front portion (332) is only abutted against the upper rim (324) of the front wall (314) of the gutter (312).

In the embodiment shown, the lower perforated section (338) has, at a front end thereof, an upwardly extending segment (342) and an upper gutter-engaging segment (343) projecting from the upwardly extending segment (342) upwardly and forwardly. In the embodiment shown, a bight (392) extends rearwardly from the gutter-engaging upper segment (343) and is superposed thereto. The bight (392) protrudes above the lower perforated section (338), the purpose of which will be defined in more details below. When engaged with the front wall (314) of the gutter (312), the upper gutter-engaging segment (343) is superposed to an upper rim (324) of the front wall (314) of the gutter (312) with a section of the upwardly extending segment (342) extends below the upper rim (324).

Figure 11B:
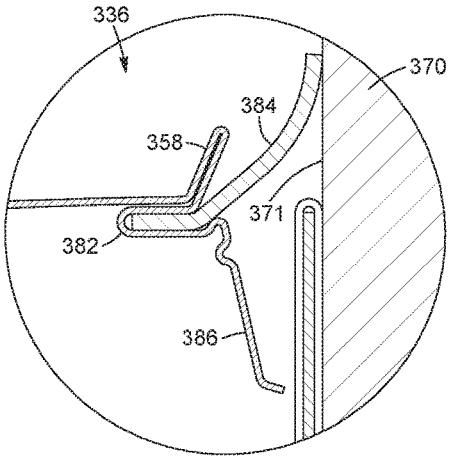
FIG. 11B is a close-up side elevation view of a rear portion of the gutter protection device of FIG. 9.

The rear portion (336) includes an upwardly extending section (358), adjacent to the central portion (334), and a rearwardly biased section (386) extending downwardly with respect to the central portion (334) and the upwardly extending section (358). Between the upwardly extending section (358) and the rearwardly biased section (386), the rear portion (336) is bent to define a sealing element receiving channel (382). A section of a sealing element (384) can be received in the sealing element receiving channel (382) with another section of the sealing element (384) protruding outwardly therefrom and outwardly from the gutter protection device (10). The sealing element (384) is configured to abut a supporting surface (371) of a supporting structure (370) when the gutter protection device (310) is engaged with the existing gutter (312), as shown in FIG. 11B.

The rearwardly biased section (386) may be made of any type of biasable material such as a resilient material. In the embodiment shown, the rearwardly biased section (386) forms a single piece with the other portions of the gutter protection device (10) and is made of the same material, for instance a folded aluminum sheet.

The central portion (334) may have an excess width with respect to the width of the open top of the gutter (312). Thus, to engage the gutter protection device (310) with the gutter (312), the rearwardly biased section (386) of the rear portion (336) may need to be temporarily bent to define a curvature therein and to be insertable in the trough. Once released, the rearwardly biased section (386) biases against an inner face (388) of the rear wall (318) of the gutter (312) and maintains the gutter protection device (310) engaged with the gutter (312). Furthermore, the excess width of the central portion (334) may provide a forced curvature to the central portion (334) when the front portion (332) contacts the front wall (314) of the gutter (312) and the rearwardly biased section (386) of the rear portion (336) is biased against the inner face (388) of the rear wall (318) of the gutter (312). The forced curvature may have the advantage of encouraging the adequate drainage of the water towards the front portion (332) of the gutter protection device (310).

As the embodiment of the gutter protection device (110), the front portion (332) of the gutter protection device (310) includes a lower perforated section (338) provided with a plurality of lower through holes (340), and an upper perforated plate (362) spaced-apart from the lower perforated section (338), also provided with a plurality of upper through holes (364). As mentioned above, in an alternative embodiment, the upper perforated plate can be a wired mesh plate. A free end (366) of the upper perforated plate (362) is inserted below and biased against the bight (392) to define the water draining chamber.

In an alternative embodiment (not shown), the recess (347) defined in the front portion (332) of the gutter protection device (310) by the lower perforated section (338), between the central portion (334) and the upwardly extending segment (342), can be at least partially filled with a foam insert. In this embodiment, the foam insert replaces the upper perforated plate (362) shown in the accompanying figures. The shape of the foam insert can substantially correspond to the shape of the recess (347) or can differ therefrom.

Figure 12:
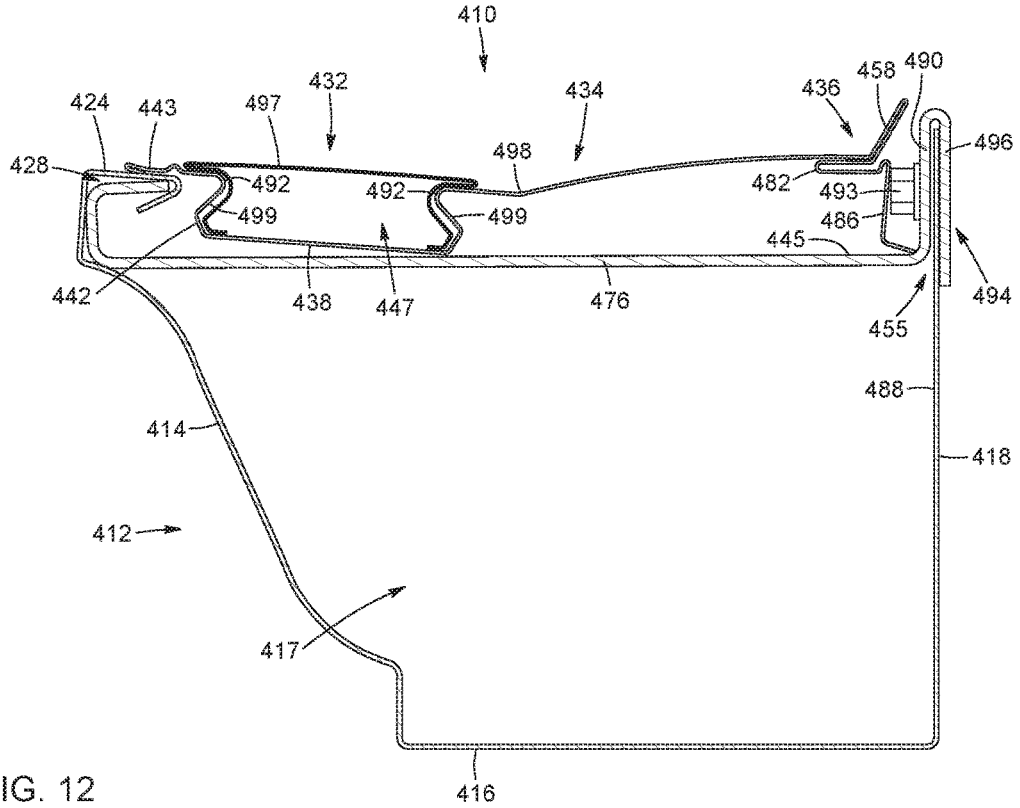
FIG. 12 is a side elevation view of a gutter protection device in accordance with another embodiment, wherein the gutter protection device is engaged with the gutter once the gutter is secured to a supporting surface of a supporting structure.

Referring to FIG. 12, an alternative embodiment of a gutter protection device (410) that may be installed over an existing gutter (412) is shown wherein the features of the gutter protection device (410) are numbered with reference numerals in the 400 series which correspond to the reference numerals of the previous embodiments. In this embodiment, the existing gutter (412) includes a front wall (414), a bottom wall (416) and a rear wall (418) defining a through (417) having an open top. The existing gutter (412) also includes a plurality of spaced-apart hangers (476) to connect the front wall (414) to the rear wall (418) and preventing them from spreading apart from each other. The spaced-apart hangers (476) shown in this embodiment substantially perform the same functions as the one shown in FIGS. 9-11 and are also secured near the open top of the existing gutter (412), but have a different configuration. In the embodiment shown, each one of the spaced-apart hangers (476) has an outer surface (445) and a rear end including an upwardly extending segment (490) and a downwardly extending segment (496) defining a channel (455) sized to receive an upper end of the rear wall (418) of the gutter (412) therein. The gutter (412) is intended to be secured to a supporting surface of a supporting structure (not shown) with a mechanical fastener (493) that secures the spaced-apart hanger (476) to the supporting surface through to the rear wall (418) of the gutter (412).

Still referring to FIG. 12, the gutter protection device (410) includes a front portion (432), a rear portion (436), and a central portion (434) extending between the front portion (432) and the rear portion (436). The rear portion (436) of the gutter protection device (412) includes similar features as the rear portion (336) of the gutter protection device (312) shown in FIGS. 9-11, with the exception that the rearwardly biased section (486) is biased against at least one of a portion of the spaced-apart hanger (476) and the mechanical fastener.

In the embodiment shown, the central portion (434) of the gutter protection device (410) extends from the rear portion (436) and defines a downwardly oriented slope from the rear portion (36) towards the front portion (32) until reaching a transition point (498) corresponding to the transition between the front portion (432) and the central portion (434). As mentioned above, the downwardly oriented slope directs the rainwater away from the rear wall (418) of the gutter (412) and away from the supporting surface to which the gutter (412) and the gutter protection device (410) are to be secured. The front portion includes a recess (447) defined by a lower perforated section (438) provided with a plurality of lower through holes and two recess segments (499) extending upwardly from a respective one of longitudinal ends of the lower perforated section (38) and each ending with a curved portion (492). The two recess segments (499), together with the lower perforated section (438), define the recess (447) in the front portion (432), the recess (447) being wider adjacent to the lower perforated section. The two recess segments (499) are configured to engage with an upper perforated plate (497) having a plurality of upper through holes, the upper perforated plate extending partially under the recess segments (499), and being biasable against the recess segments (499). In an embodiment, the upper perforated plate is a wire mesh plate. In the embodiment shown, the upper perforated plate (462) comprises a downwardly extending section at each longitudinal end thereof, each downwardly extending section being inserted in the recess and biased against a respective one of the two segments. The superposition of the upper perforated plate above the lower perforated section define a water draining chamber inbetween. In an embodiment, when the upper perforated plate is inserted in the recess (447), an outward curvature is defined in the upper perforated plate or the mesh to avoid accumulation of debris thereon. The front section (432) ends with an upper gutter-engaging segment (443) projecting outwardly from a forward one of the two recess segments (499). As mentioned above, when engaged with the gutter (412), the upper gutter-engaging segment (443) is superposed to the upper rim (424) of the front wall (414) of the gutter (412) to engage the gutter protection device (410) therewith.

In an alternative embodiment, the recess (447) in the front portion (432) is at least partially filled with a foam insert (not shown) instead of including the upper perforated plate (462) or the wire mesh plate. In this embodiment, the foam insert is superposed to the lower perforated section (438) and allows water to flow therethrough. As detailed above, the foam insert (449) can be made of several suitable materials including a plastic open-cell foam material such as an open pore polyether foam, the gutter foam filter Gutter Stuff™.

Figure 13:
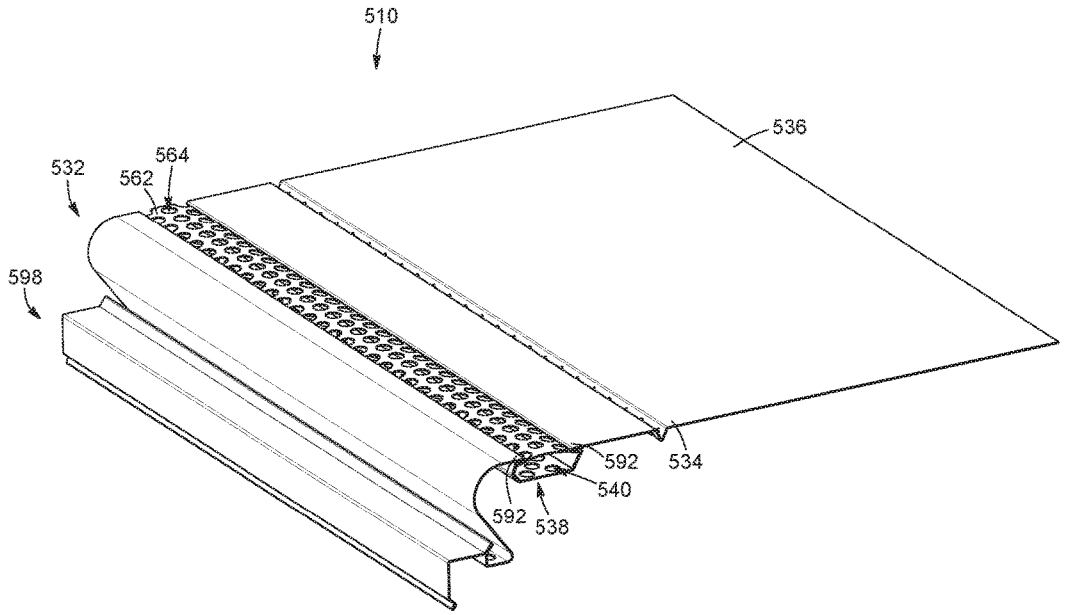
FIG. 13 is a side perspective view of a gutter protection device in accordance with another embodiment, wherein the gutter protection device includes a rear portion at least partially insertable under roof shingles.
Figure 14:
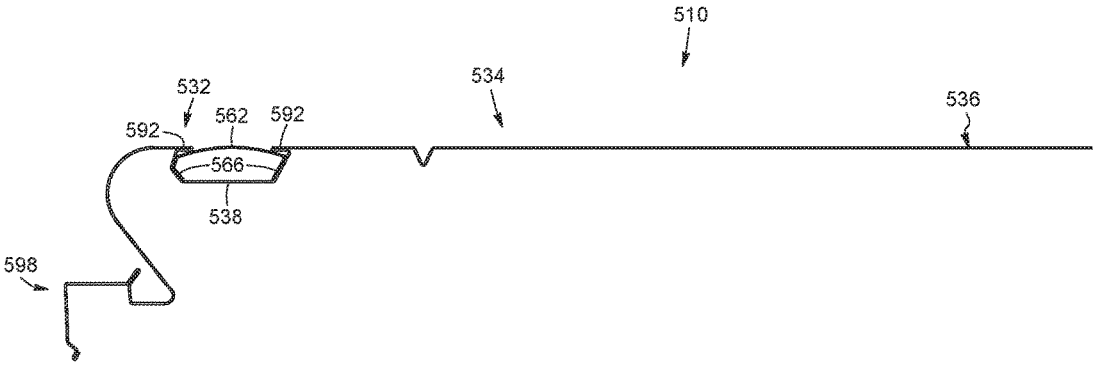
FIG. 14 is a side elevation view of the gutter protection device of FIG. 13.

Referring now to FIGS. 13 and 14, there is shown an alternative embodiment of a gutter protection device including a rear portion (536) at least partially insertable under roof shingles (not shown). The features of the gutter protection device (510) are numbered with reference numerals in the 500 series which correspond to the reference numerals of the previous embodiments.

The gutter protection device (510) includes a front portion (532), a rear portion (436), and a central portion (534), the central portion (534) extending between the front portion (532) and the rear portion (536). The front portion (532)

includes a clip portion (598) engageable with the front wall of a gutter (not shown) when the gutter protection device (510) is mounted over the gutter to cover the open top thereof.

In the front portion (532), extending rearwardly from the clip portion (598), the gutter protection device (510) includes a lower perforated section (538), provided with a plurality of lower through holes (540), and an upper perforated plate (562), also provided with a plurality of upper through holes (564) and spaced-apart from the lower perforated section (538). As mentioned above, in an alternative embodiment, the upper perforated plate can be a wired mesh plate. The free ends (566) of the upper perforated plate (562) are inserted below and biased against the bights (592) to define the water draining chamber. The bights (592) therefore perform a similar function as the curved portions (492) shown in FIG. 12. More particularly, the upper perforated plate (562) is bent and partially inserted in the water draining chamber.

Figure 15:
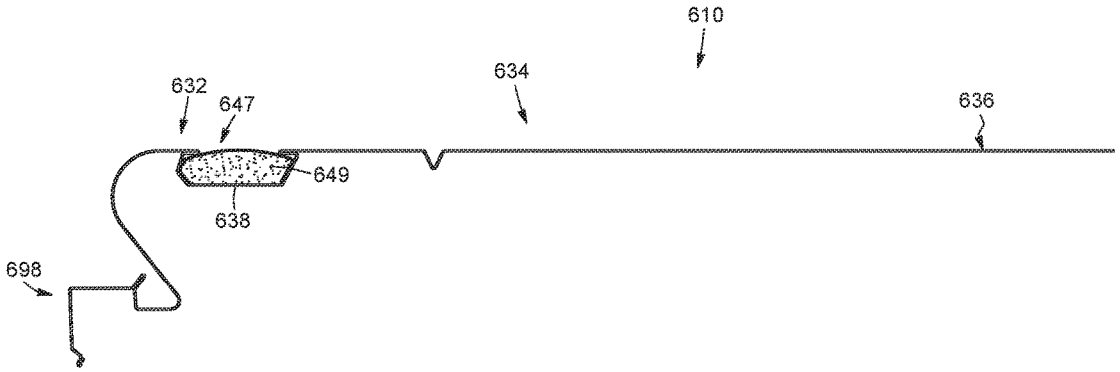
FIG. 15 is a side elevation view of a gutter protection device in accordance with another embodiment, wherein a foam insert is inserted in a recess at least partially defined by a lower perforated section of the gutter protection device.

Referring now to FIG. 15, there is shown an alternative embodiment of a gutter protection device of FIGS. 13 and 14 wherein a recess (647) in the front portion (632) is filled with a foam insert (649). The foam insert (649) replaces the upper perforated plate (662) shown in FIGS. 13 and 14. The foam insert (649) is superposed to the lower perforated section (638) and allows water to flow therethrough. It is appreciated that the shape of the recess (647) and the foam insert (649) can differ from the embodiment shown. As detailed above, the foam insert (649) can be made of several suitable materials including a plastic open-cell foam material such as an open pore polyether foam, the gutter foam filter Gutter Stuff™.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A gutter protection assembly comprising:

a gutter comprising:

a front wall, a bottom wall and a rear wall, the rear wall comprising at least one crimp protruding outwardly from an outer face of the rear wall of the gutter with a hole defined in the rear wall of the gutter for each of the at least one crimp, each of the holes being aligned with a respective one of the at least one crimp; and a gutter protection device comprising:

a front portion engageable with the front wall of the gutter and a rear portion, the rear portion comprising:

a gutter wall-engaging section comprising an outer downward segment provided with at least one hook configured to engage with the at least one crimp protruding from the rear wall of the gutter thereby providing a support for the gutter to hang from.

2. The gutter protection assembly of claim 1, wherein the at least one crimp comprises a plurality of longitudinally spaced-apart crimps provided at a substantially constant height with respect to an upper edge of the rear wall.

3. The gutter protection assembly of claim 1, wherein the outer downward segment extends rearwardly to the rear wall of the gutter when the gutter protection device is engaged with the rear wall of the gutter and the at least one hook comprises an inner fold protruding inwardly and upwardly from the outer downward segment, towards the rear wall of the gutter.

4. The gutter protection assembly of claim 1, wherein the at least one hook comprises a continuous hook extending along a length of the outer downward segment defined between two longitudinally spaced-apart ends thereof.

5. The gutter protection assembly of claim 1, wherein the at least one hook is configured to engage with the at least one crimp to permit translational movements between the gutter and the gutter protection device along a longitudinal axis.

6. The gutter protection assembly of claim 1, wherein the at least one crimp is tapered in shape with a wider portion in a lower portion of the at least one crimp.

7. A gutter protection assembly comprising:

a gutter having a gutter longitudinal axis, the gutter comprising:

a front wall, a bottom wall and a rear wall, the rear wall comprising at least one crimp protruding outwardly from an outer face of the rear wall of the gutter; and a gutter protection device comprising:

a front portion engageable with the front wall of the gutter, a rear portion, and a central portion extending between the front portion and the rear portion, the rear portion comprising:

a gutter wall-engaging section comprising:

an outer downward segment provided with at least one hook configured to engage with the at least one crimp protruding from the rear wall of the gutter thereby providing a support for the gutter to hang from, the outer downward segment extending rearwardly to the rear wall of the gutter when the gutter protection device is engaged therewith and the at least one hook comprising an inner fold protruding inwardly and upwardly from the outer downward segment, towards the rear wall of the gutter, with a free end thereof engaging the at least one crimp; and an inner downward segment to define, together with the outer downward segment, a channel thereinbetween to receive an upper end of the rear wall of the gutter therein, the inner downward segment extending downwardly relative to the central portion of the gutter protection device; and an upwardly extending section projecting upwardly and continuously from the outer downward segment and the inner downward segment, the upwardly extending section extending above the rear wall of the gutter when the gutter protection device and the gutter are engaged together, the gutter protection assembly being securable to a supporting structure through the upwardly extending section with the gutter hanging from the gutter protection device; the gutter being translatable along the gutter longitudinal axis when the gutter protection device is engaged with the gutter at the front portion and the rear portion and secured to the supporting structure through the upwardly extending section.

8. The gutter protection assembly of claim 7, wherein the gutter protection device further comprises a central portion between the front portion and the rear portion and the upwardly extending section extends continuously and upwardly from the central portion.

9. The gutter protection assembly of claim 8, wherein the central portion is generally planar and further comprises longitudinally extending reinforcing ribs.

10. The gutter protection assembly of claim 7, wherein the upwardly extending section further comprises a plurality of spaced-apart fastener holes extending through the upwardly extending section to receive fasteners to secure the gutter protection device to the supporting structure.

11. The gutter protection assembly of claim 10, wherein the fasteners holes extend above the rear wall of the gutter when the gutter protection device and the gutter are engaged together.

12. The gutter protection assembly of claim 7, wherein the upwardly extending section and the outer downward segment of the gutter protection device contact the supporting structure when the gutter protection assembly is mounted thereto.

13. The gutter protection assembly of claim 7, wherein the upwardly extending section, the inner downward segment and the outer downward segment are made of a folded single material plate.

14. The gutter protection assembly of claim 13, wherein the folded single material plate is folded upwardly to define the upwardly extending section, then folded downwardly to define the inner downward segment, then folded sequentially upwardly and downwardly to define the gutter wall-engaging section with a channel defined in between, the channel being configured to receive an upper section of the rear wall of the gutter inbetween.

15. A gutter protection assembly comprising:

a gutter having a gutter longitudinal axis, the gutter comprising:

a front wall, a bottom wall and a rear wall, the rear wall comprising at least one crimp protruding outwardly from an outer face of the rear wall of the gutter; and a gutter protection device comprising:

a front portion engageable with the front wall of the gutter, a rear portion, and a central portion extending between the front portion and the rear portion, the rear portion comprising:

a gutter wall-engaging section comprising:

an outer downward segment provided with at least one hook configured to engage with the at least one crimp protruding from the rear wall of the gutter thereby providing a support for the gutter to hang from, the outer downward segment extending rearwardly to the rear wall of the gutter when the gutter protection device is engaged therewith and the at least one hook comprising an inner fold protruding inwardly and upwardly from the outer downward segment, towards the rear wall of the gutter, with a free end thereof engaging the at least one crimp; and an inner downward segment to define, together with the outer downward segment, a channel thereinbetween to receive an upper end of the rear wall of the gutter therein, the inner downward segment extending downwardly relative to the central portion of the gutter protection device; and an upwardly extending section projecting upwardly and continuously from the outer downward segment and the inner downward segment, the upwardly extending section extending above the rear wall of the gutter when the gutter protection device and the gutter are engaged together and comprising a plurality of spaced-apart fasteners holes extending therethrough to receive fasteners to secure the gutter protection device to a supporting structure, the gutter protection assembly being securable to the supporting structure through the upwardly extending section with the gutter hanging from the gutter protection device.

16. The gutter protection assembly of claim 15, wherein the gutter protection device further comprises a central portion between the front portion and the rear portion and the upwardly extending section extends continuously and upwardly from the central portion.

17. The gutter protection assembly of claim 15, wherein the upwardly extending section and the outer downward segment of the gutter protection device contact the supporting structure when the gutter protection assembly is mounted thereto.

18. The gutter protection assembly of claim 15, wherein the upwardly extending section, the inner downward segment and the outer downward segment are made of a folded single material plate.

19. The gutter protection assembly of claim 18, wherein the folded single material plate is folded upwardly to define the upwardly extending section, then folded downwardly to define the inner downward segment, then folded sequentially upwardly and downwardly to define the gutter wall-engaging section with a channel defined in between, the channel being configured to receive an upper section of the rear wall of the gutter in between.

20. The gutter protection assembly of claim 16, wherein the central portion is generally planar and further comprises longitudinally extending reinforcing ribs.

21. The gutter protection assembly of claim 15, wherein the gutter is translatable along the gutter longitudinal axis when the gutter protection device is engaged with the gutter at the front portion and the rear portion and secured to the supporting structure through the upwardly extending section.

* * * * *